US010618344B2

(12) United States Patent
Beardsley

(10) Patent No.: US 10,618,344 B2
(45) Date of Patent: Apr. 14, 2020

(54) TELESCOPIC MARKING ASSEMBLY

(71) Applicant: Dana Beardsley, Sandisfield, MA (US)

(72) Inventor: Dana Beardsley, Sandisfield, MA (US)

( * ) Notice: Subject to any disclaimer, the term of this patent is extended or adjusted under 35 U.S.C. 154(b) by 83 days.

(21) Appl. No.: 15/883,188

(22) Filed: Jan. 30, 2018

(65) Prior Publication Data

US 2019/0232713 A1 Aug. 1, 2019

(51) Int. Cl.

| | |
|---|---|
| ***B43K 23/00*** | (2006.01) |
| ***B25G 1/04*** | (2006.01) |
| ***B25H 7/04*** | (2006.01) |
| ***B25G 3/38*** | (2006.01) |
| *B25G 1/10* | (2006.01) |

(52) U.S. Cl.
CPC ..... *B43K 23/001* (2013.01); *B25G 1/04* (2013.01); *B25G 3/38* (2013.01); *B25H 7/045* (2013.01); *B25G 1/102* (2013.01)

(58) Field of Classification Search
CPC .... A46B 5/0033; A46B 5/005; B43K 23/004; Y10T 16/473; Y10T 403/32467; B25G 1/04; B25G 1/043; B25G 1/046
USPC ..... 401/6, 48; 15/144.4; 16/405, 427, 429
See application file for complete search history.

(56) References Cited

U.S. PATENT DOCUMENTS

| | | | | |
|---|---|---|---|---|
| 659,026 | A | 10/1900 | Goldsmith | |
| 2,588,757 | A | 3/1952 | Peeples, Jr. | |
| 2,902,761 | A | 9/1959 | Koenig | |
| 3,938,218 | A | 2/1976 | DeAmicis | |
| 4,073,529 | A * | 2/1978 | Ostrin | A63B 47/02 294/19.2 |
| D248,863 | S | 8/1978 | Miyamoto | |
| 4,653,142 | A | 3/1987 | Upton | |
| 5,423,584 | A * | 6/1995 | Pasternak | A63B 47/02 294/19.2 |
| 2016/0008996 | A1 | 1/2016 | Dunn | |

* cited by examiner

*Primary Examiner* — David J Walczak
*Assistant Examiner* — Joshua R Wiljanen

(57) ABSTRACT

A telescopic marking assembly for marking on a surface or object that is out of a user's reach includes a rod that has an adjustable length. The rod is selectively extended to reach an object that is out of a user's reach. A tube is movably coupled to the rod and the tube is selectively positionable at a selected angle with respect to the rod. The tube insertably receives a writing utensil thereby facilitating the writing utensil to write on the object that is out of reach.

9 Claims, 3 Drawing Sheets

TELESCOPIC MARKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to marking devices and more particularly pertains to a new marking device for marking on an object or surface that is out of a user's reach.

BRIEF SUMMARY OF THE INVENTION

An embodiment of the disclosure meets the needs presented above by generally comprising a rod that has an adjustable length. The rod is selectively extended to reach an object that is out of a user's reach. A tube is movably pivotally coupled to the rod and the tube is selectively positionable at a selected angle with respect to the rod. The tube insertably receives a writing utensil thereby facilitating the writing utensil to write on the object that is out of reach.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
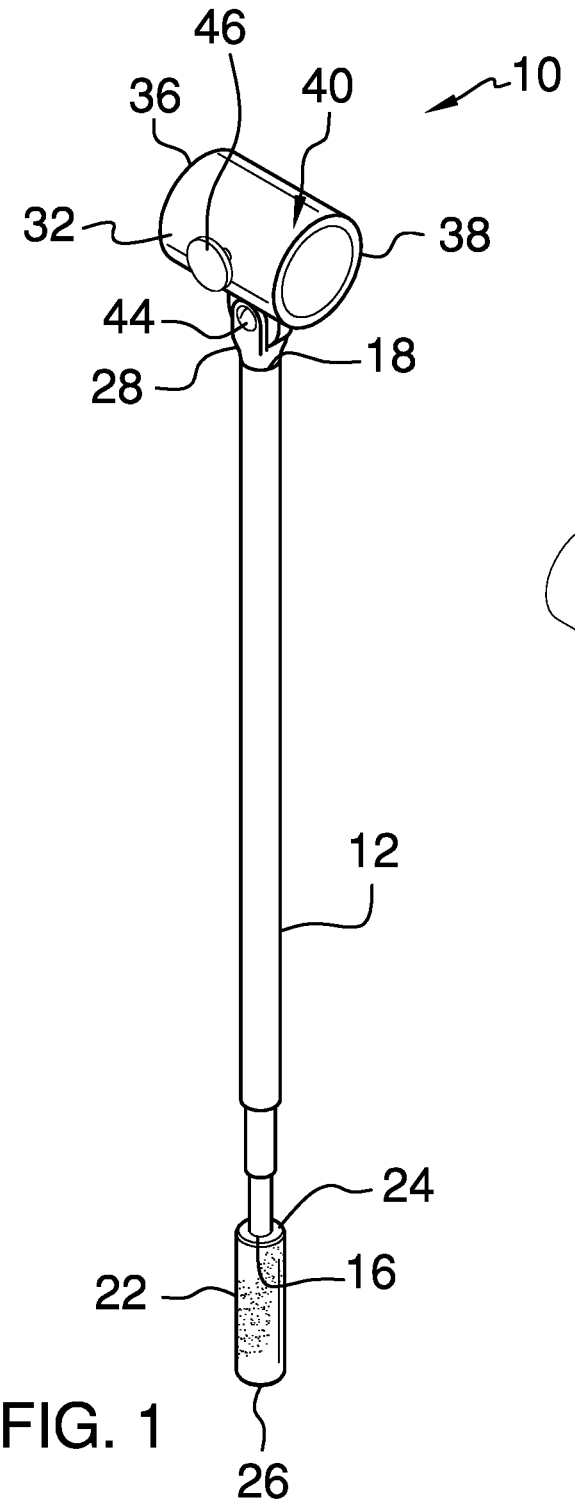
FIG. 1 is a perspective view of a telescopic marking assembly according to an embodiment of the disclosure.
Figure 2:
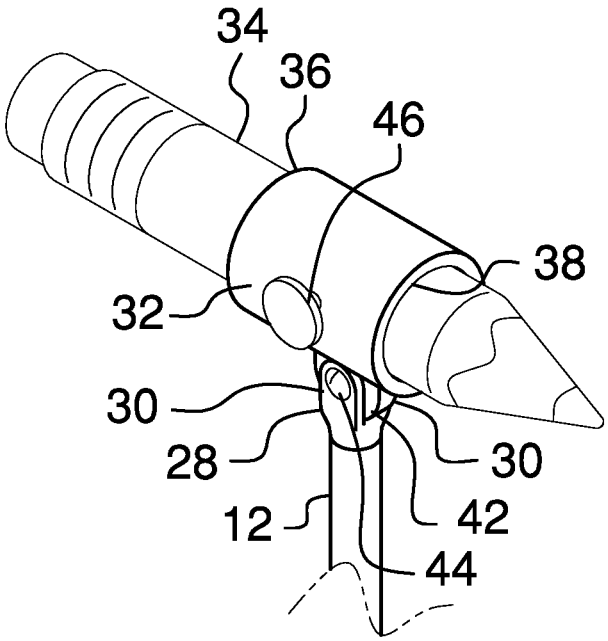
FIG. 2 is a top perspective in-user view of an embodiment of the disclosure.
Figure 3:
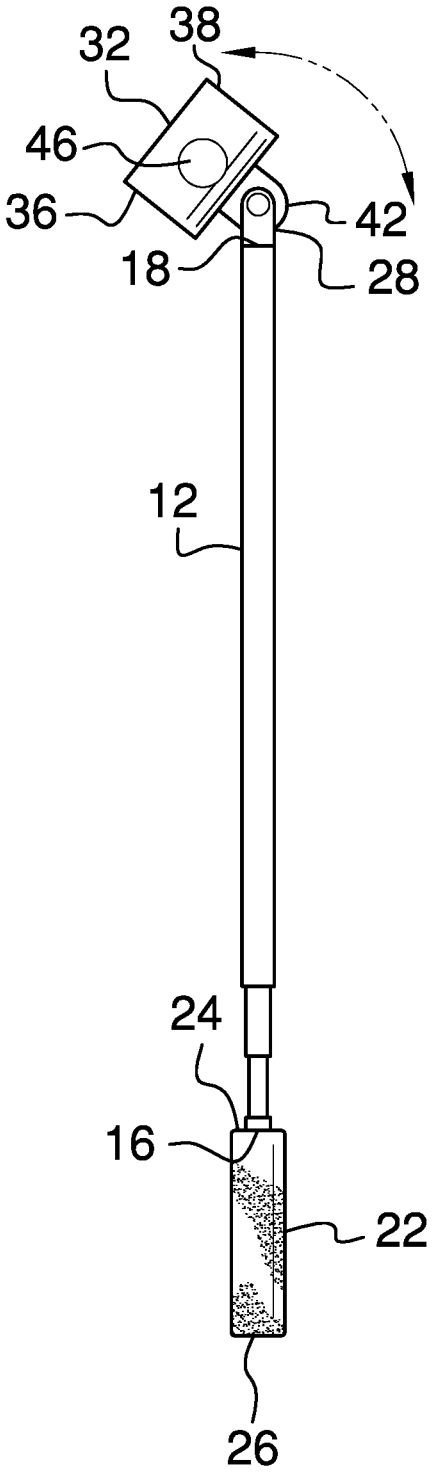
FIG. 3 is a right side view of an embodiment of the disclosure.
Figure 4:
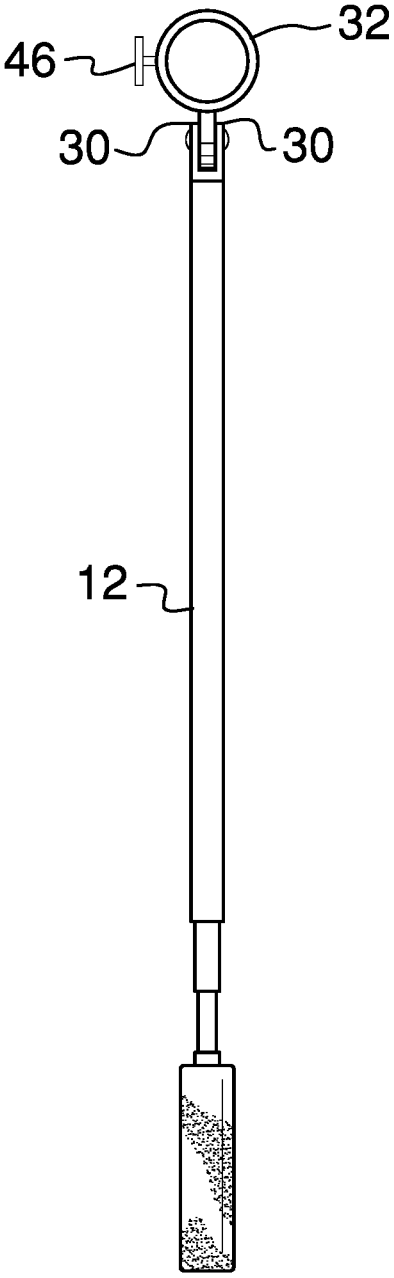
FIG. 4 is a front view of an embodiment of the disclosure.
Figure 5:
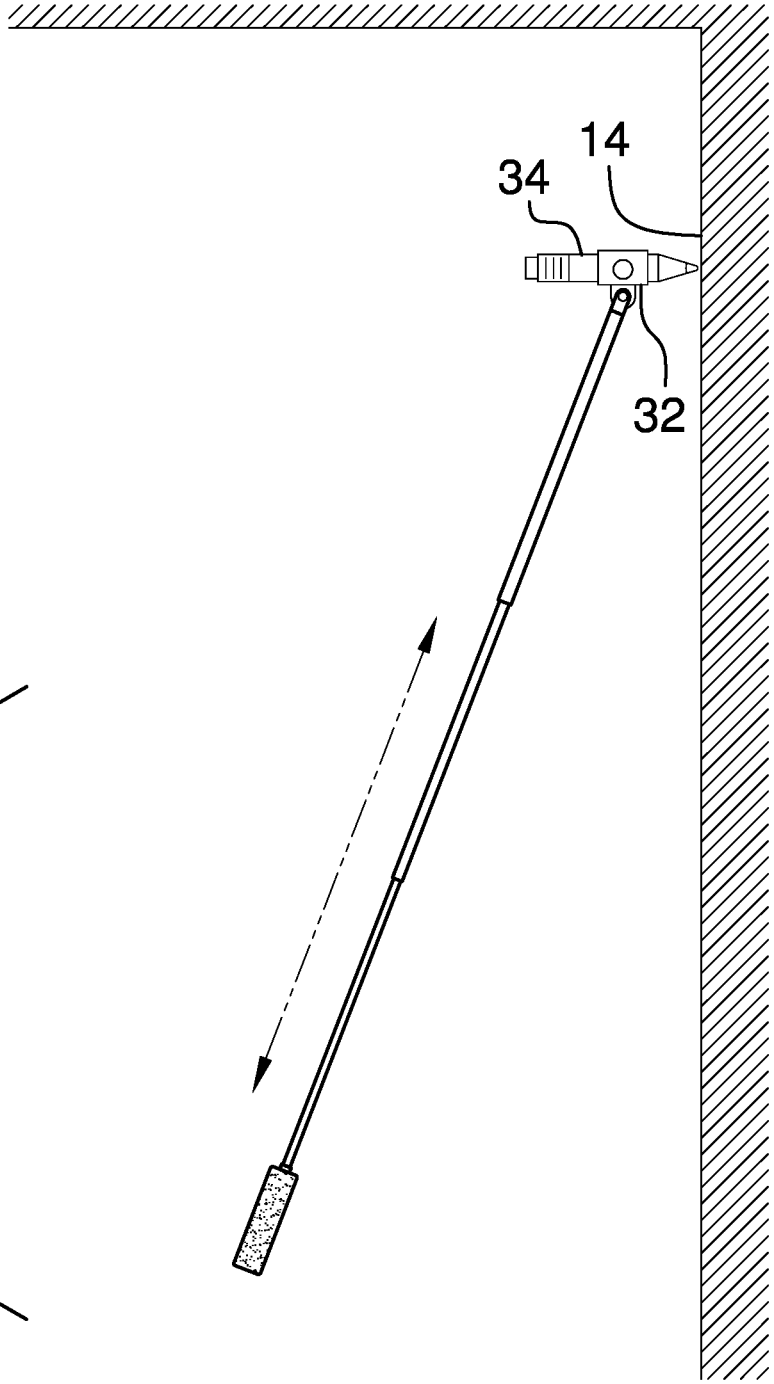
FIG. 5 is a perspective in-use view of an embodiment of the disclosure.

With reference now to the drawings, and in particular to FIGS. 1 through 5 thereof, a new marking device embodying the principles and concepts of an embodiment of the disclosure and generally designated by the reference numeral 10 will be described.

As best illustrated in FIGS. 1 through 5, the telescopic marking assembly 10 generally comprises a rod 12 that has an adjustable length. The rod 12 is selectively extended to reach an object 14 that is out of a user's reach. The rod 12 has a first end 16, a second end 18 and a plurality of sections 20 that are each slidably coupled together such that the rod 12 has telescopically adjustable length. The rod 12 may be adjusted to a length ranging between approximately 25.0 cm and 100.0 cm.

A handle 22 is coupled to the first end 16 of the rod 12 for gripping. The handle 22 has a primary end 24 and a secondary end 26 and the primary end 24 is coupled to the first end 16 of the rod 12. The handle 22 may be comprised of a resiliently compressible material for enhanced gripping. A swivel 28 is coupled to the rod 12 and the swivel 28 is positioned on the second end 18 of the rod 12. The swivel 28 has a pair of members 30 that are spaced apart from each other and the members 30 extend away from the second end 18.

A tube 32 is pivotally coupled to the swivel 28 such that the tube 32 is selectively positionable at a selected angle with respect to the rod 12. The tube 32 insertably receives a writing utensil 34 thereby facilitating the writing utensil 34 to write on the object 14 that is out of reach. The writing utensil 34 may be a pencil or the like and the object 14 that is out of reach may be a sheet of plywood on a wall, cabinetry that is mounted to a wall and any other elevated object. Additionally, the object 14 may be written on for construction purposes such as scribing a nail line, a cut line and any other marking related to construction.

The tube 32 has a first end 36 and a second end 38 and the first end 36 slidably receives the writing utensil 34 having the writing utensil 34 extending outwardly from the second end 38. A tab 42 extends downwardly from the tube 32 and the tab 42 is positioned between the members 30 on the swivel 28. A pin 44 extends through each of the members 30 and the tab 42 such that the tube 32 is pivotally retained on the tube 32. Each of the members 30 frictionally engages the tab 42 to releasably retain the tube 32 at the selected angle with respect to the rod 12. A screw 46 extends through the tube 32 and the screw 46 is rotatable in a first direction and a second direction. The screw 46 frictionally engages the writing utensil 34 when the screw 46 is rotated in the first direction to retain the writing utensil 34 in the tube 32. The screw 46 disengages the writing utensil 34 when the screw 46 is rotated in the second direction for removing the writing utensil 34 from the tube 32.

In use, the writing utensil 34 is positioned in the tube 32 and the screw 46 is rotated in the first direction to retain the writing utensil 34 in the tube 32. The tube 32 is positioned at a selected angle with respect to the rod 12. The rod 12 is extended to a selected length and the handle 22 is gripped. The rod 12 is manipulated to position the writing utensil 34 against the object 14 that is out of reach. Moreover, the rod 12 is manipulated to facilitate the writing utensil 34 to write on the object 14. In this way the object 14 that is out of reach is written on without the use of a ladder, a step stool and any other elevating device.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A telescopic marking assembly comprising:

a writing utensil;

a rod having an adjustable length wherein said rod is configured to be extended to reach an object that is out of a user's reach; and a tube being movably coupled to said rod such that said tube is selectively positionable at a selected angle with respect to said rod, said writing utensil being removably coupled to said tube thereby facilitating said writing utensil to write on the object that is out of reach.

2. The assembly according to claim 1, wherein said rod has a first end and a second end, said rod having a plurality of sections each being slidably coupled together such that said rod has telescopically adjustable length.

3. The assembly according to claim 2, further comprising a handle being coupled to said first end of said rod wherein said handle is configured to be gripped, said handle having a primary end and a secondary end, said primary end being coupled to said first end of said rod.

4. The assembly according to claim 2, wherein said tube has a first end and a second end, said first end of said tube slidably receiving said writing utensil such that said writing utensil extends outwardly from said second end.

5. The assembly according to claim 1, further comprising a swivel being coupled to said rod, said swivel positioned on said second end of said rod, said swivel having a pair of members being spaced apart from each other, said members extending away from said second end of said rod.

6. The assembly according to claim 5, further comprising a tab extending downwardly from said tube, said tab being positioned between each of said members on said swivel.

7. The assembly according to claim 1, further comprising a screw extending through said tube wherein said screw frictionally engages said writing utensil to retain said writing utensil in said tube.

8. The assembly according to claim 7, further comprising a pin extending through each of said members and said tab such that said tube is pivotally retained on said swivel.

9. A telescopic marking assembly comprising:

a rod having an adjustable length wherein said rod is configured to be extended to reach an object that is out of a user's reach, said rod having a first end and a second end, said rod having a plurality of sections each being slidably coupled together such that said rod has telescopically adjustable length;

a handle being coupled to said first end of said rod wherein said handle is configured to be gripped, said handle having a primary end and a secondary end, said primary end being coupled to said first end of said rod;

a swivel being coupled to said rod, said swivel being positioned on said second end of said rod, said swivel having a pair of members being spaced apart from each other, said members extending away from said second end;

a tube being pivotally coupled to said swivel such that said tube is selectively positionable at a selected angle with respect to said rod, said writing utensil being removably coupled to said tube thereby facilitating the writing utensil to write on the object that is out of reach, said tube having a first end and a second end, said first end of said tube slidably receiving said writing utensil such that said writing utensil extends outwardly from said second end;

a tab extending downwardly from said tube, said tab being positioned between each of said members on said swivel;

a pin extending through each of said members and said tab such that said tube is pivotally retained on said swivel; and a screw extending through said tube wherein said screw frictionally engages said writing utensil to retain said writing utensil in said tube.

* * * * *